United States Patent [19]

Adamski et al.

[11] Patent Number: 4,710,669

[45] Date of Patent: Dec. 1, 1987

[54] INTERNAL ELECTRICAL CONNECTOR FOR A TENSION MASK TUBE

[75] Inventors: Alfred Adamski, Elmhurst; Thomas P. DeFranco, Norridge; Lawrence W. Dougherty, Sleepy Hollow, all of Ill.

[73] Assignee: Zenith Electronics Corporation, Glenview, Ill.

[21] Appl. No.: 811,051

[22] Filed: Dec. 19, 1985

[51] Int. Cl.[4] ..... H01J 29/07; H01J 29/92

[52] U.S. Cl. ..... 313/402; 313/408; 313/477 HC; 313/479

[58] Field of Search ..... 313/402, 404, 408, 477 HC, 313/479, 482

[56] References Cited

U.S. PATENT DOCUMENTS

| | | | |
|---|---|---|---|
| 2,951,179 | 8/1960 | Evans | 313/402 X |
| 3,541,373 | 11/1970 | Barr | 313/85 |
| 3,796,903 | 3/1974 | Yamazaki et al. | 313/404 |
| 4,333,037 | 6/1982 | Andre et al. | 313/408 X |
| 4,344,015 | 8/1982 | Marschka | 313/466 |
| 4,433,267 | 2/1984 | Kuryla et al. | 313/402 |

*Primary Examiner*—David K. Moore
*Assistant Examiner*—K. Wieder
*Attorney, Agent, or Firm*—Cornelius J. O'Connor

[57] ABSTRACT

A conductive connector arrangement for use in a CRT comprising a funnel having an internal Aquadag coating, a faceplate having a luminescent screen deposited upon its display surface, a ring formed of a non-conductive material having at least one recess thereon and interposed between the funnel and faceplate for supporting a mask in registration with the screen and an internal magnetic shield disposed within the funnel. The connector arrangement serves to establish the Aquadag, the screen, the mask and the shield at a common electrical potential. To this end the connector comprises a clip formed of a resilient conductive material and configured for retention in the ring recess. A first contact supported by the clip effects a conductive engagement between the screen and the clip. A second contact, also supported by the clip, effects a conductive engagement between the funnel coating and the clip. An electrical connection is effected between the clip and the mask. Finally, a mechanical and electrical connection is effected between the clip and the magnetic shield. In this manner, the screen, the Aquadag, the mask and the magnetic shield are established at a common potential by a unitary self-supporting arrangement.

6 Claims, 7 Drawing Figures

INTERNAL ELECTRICAL CONNECTOR FOR A TENSION MASK TUBE

CROSS REFERENCE TO RELATED APPLICATION(S)

This application is related to, but in no way dependent upon, application Serial No. 754,787 filed July 12, 1985 and is owned by the owner of this application.

BACKGROUND OF THE INVENTION

1. Field of the Invention:

This invention relates generally to the field of color cathode ray tubes which are characterized by a tensioned color selection mask.

More particularly this invention concerns a low-cost unitary connector arrangement for establishing diverse constituents of a cathode ray tube at a common electrical potential.

2. Definitions

As used herein the expression "CRT" means cathode ray tube.

As used herein the expression "IMS" means Internal Magnetic Shield.

As used herein the term "shadow mask" means a color selection electrode.

3. Art

The following patents are being submitted to the Patent and Trademark Office for its evaluation as to their possible relevance to the claimed subject matter. It is believed to be the closest art of which applicants are aware, but applicants make no admission as to the fact of its being "prior art", to its relevance in fact, to its legal sufficiency or to its priority in time, nor do applicants represent that no better art exists.

1. U.S. Pat. No. 3,531,373—R. O. Barr
2. U.S. Pat. No. 4,344,015—Marschka
3. U.S. Pat. No. 4,433,267—Kuryla, et al 4. Shortcomings of the Prior Art Among the problems, defects and other drawbacks found in the prior art the following are noted:

1. Invariably the prior art practice resorts to a multiplicity of separate components to effect the requisite common electrical potential between the screen, mask, Aquadag coating and internal magnetic shield.

2. This approach is cost intensive, not only from a component standpoint but also because of the labor costs incurred in assemblying the components in a CRT.

FEATURES, ADVANTAGES AND OBJECTS OF THE INVENTION

Among the features, advantages and objects of the present invention are the following:

1. To provide a low cost connector arrangement for establishing the screen, mask, Aquadag coating and IMS at a common electrical potential.

2. It is another object to provide a unitary internal connector arrangement for use in a color CRT.

3. It is also an object of the invention to provide a low cost connector arrangement that entails minimum labor in assembling and installation.

BRIEF DESCRIPTION OF THE FIGURES

The Figures are views depicting the invention.

DESCRIPTION OF A PREFERRED EMBODIMENT

Figure 1:
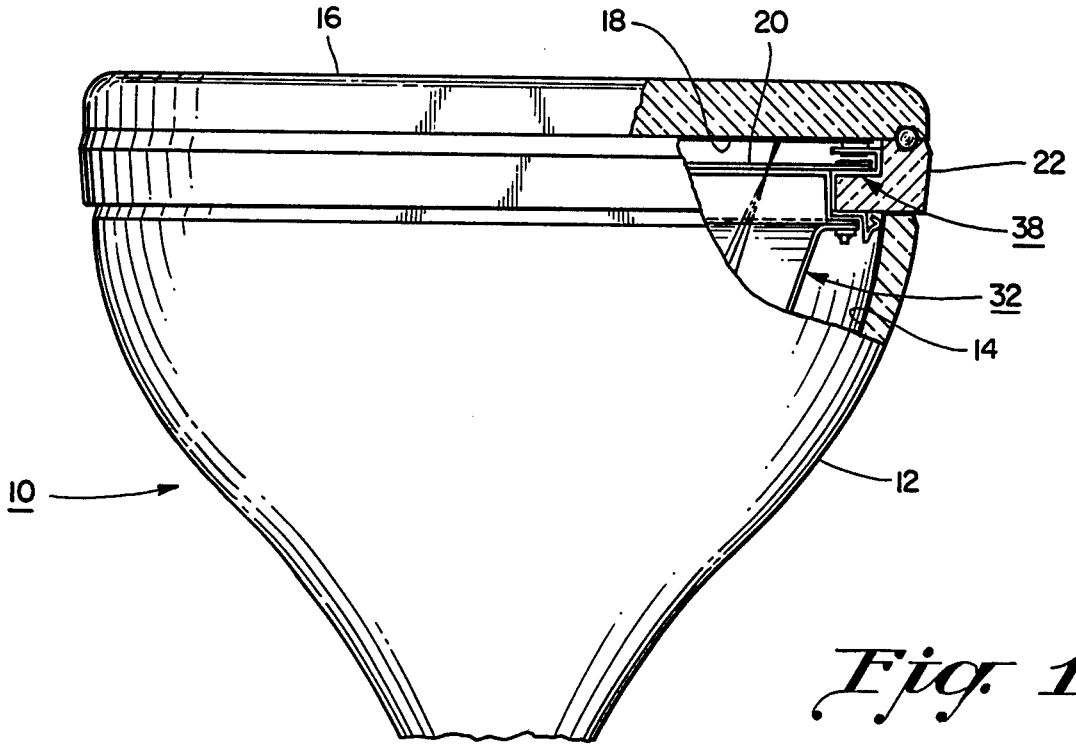
FIG. 1 is a side view of a CRT, partially cut-away, depicting a connector arrangement according to the invention positioned in situ.
Figure 2:
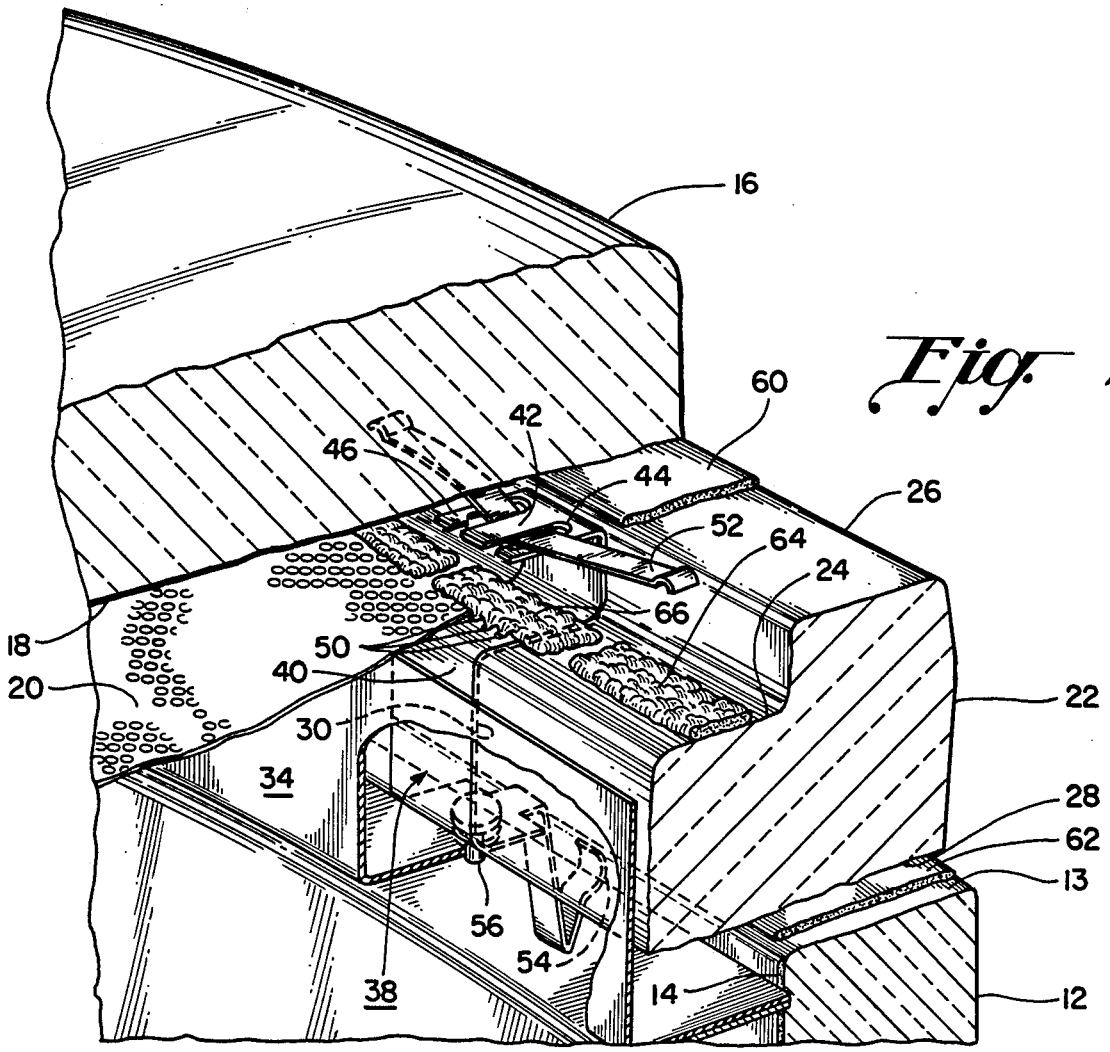
FIG. 2 is a fragmentary perspective view of that portion of the CRT shown cut-away in FIG. 1.

This specification includes a description of the invention and of the best mode presently contemplated for carrying out the invention and instructions on how to make and use the invention.

Best Mode

Figure 3:
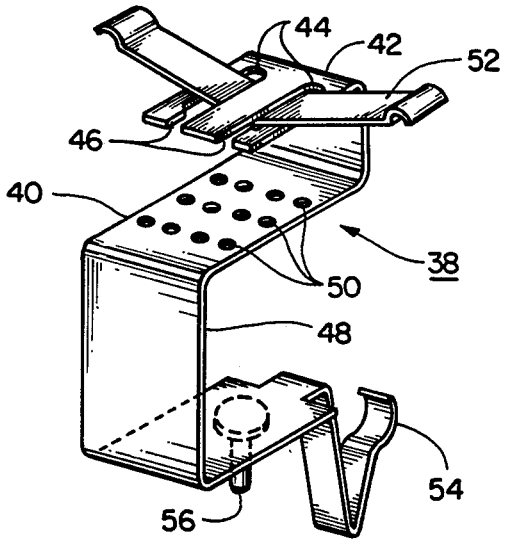
FIG. 3 is a perspective view of a connector arrangement constructed in accordance with the invention.
Figure 6:
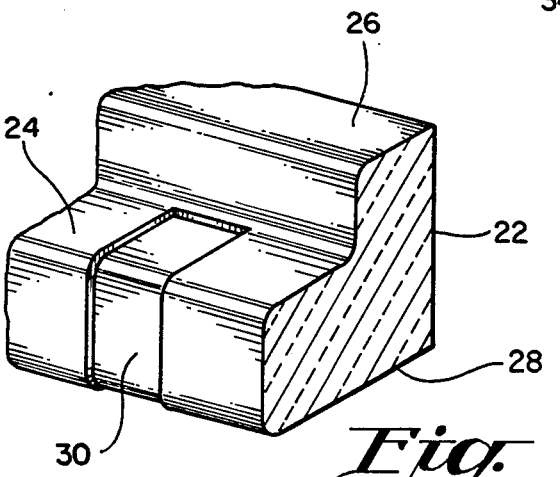
FIG. 6 is a sectioned fragment of the CRT's shadow mask supporting collar showing a recessed seat for receiving the connector arrangement of FIG. 3.

The invention is disclosed in the drawings as follows:

| Referent Number | Referent Name | Brief Statement of Referent Connections, Function, Operation and/or Result, if Appropriate |
|---|---|---|
| 10 | CRT | |
| 12 | Funnel | |
| 13 | Seal land | Forward edge of Funnel 12 |
| 14 | Aquadag | Conductive coating formed on inside wall of funnel 12. |
| 16 | Faceplate | |
| 18 | Screen | Luminescent screen formed on inside surface of faceplate 16. |
| 20 | Tension Mask | Color selection electrode. |
| 22 | Ring | A frame formed of a non-conductive material, e.g. glass, having a central opening coextensive with screen 18 and interposed between funnel 12 and faceplate 16 for supporting mask 20 in registration with screen 18. |
| 24 | Ledge | Surface formed on ring 22 to which the periphery of mask 20 is secured. |
| 26 | Forward face | Face of ring 22 confronting faceplate 16. |
| 28 | Rear face | Face of ring 22 confronting the seal land of funnel 12. |
| 30 | Seat | Recess(es) formed on ring ledge 24 only one shown, see FIG. 6, one of three, or more, formed on ledge 24 preferably radially spaced apart 120 degrees relative to the geometric center of faceplate 16. |
| 32 | IMS | Internal Magnetic Shield. |
| 34 | Collar | Forward portion of IMS 32. |
| 35 | Hole | Mounting hole(s) in collar 34. |
| 36 | Cone | Rearwardly extending portion of IMS 32. |
| 37 | Hole | Mounting hole(s) in cone 36. |
| 38 | Unitary Connector Arrangement | See FIG. 3, one of three or more connectors individually seated in an assigned recess 30. |

-continued

Figure 4:
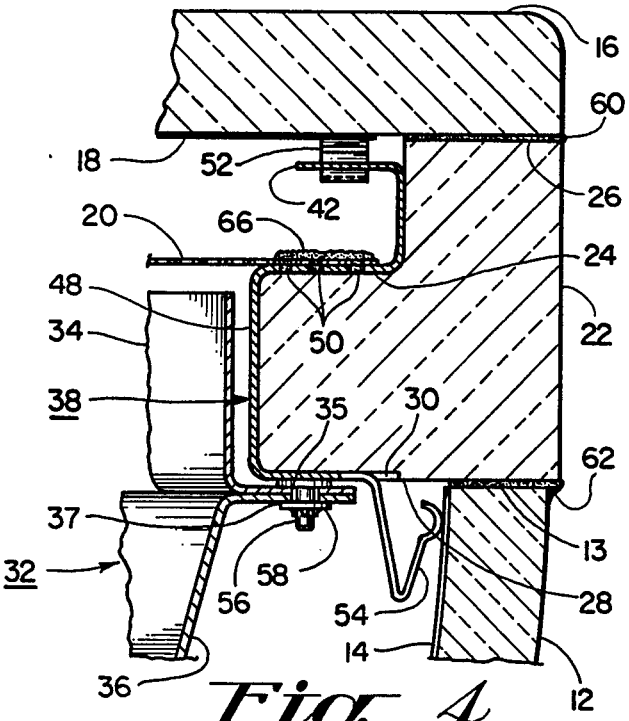
FIG. 4 is an enlarged view of the sectioned portion of FIG. 1 illustrating the manner in which the connector arrangement effects the requisite common electrical potential.
Figure 5:
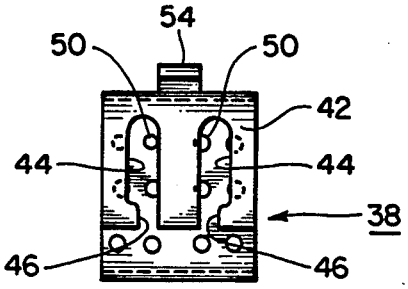
FIG. 5 is a top view of the connector arrangement shown in FIG. 3.

| Referent Number | Referent Name | Brief Statement of Referent Connections, Function, Operation and/or Result, if Appropriate |
|---|---|---|
| 40 | Clip | Serpentine base member of connector 38 formed of a resilient conductive material. |
| 42 | Shelf | Uppermost terminus of Clip 40. |
| 44 | Slots | Elongated apertures in shelf 42 for retaining first contact means 52 on shelf 42. |
| 46 | Necks | Reduced entrances to slots 44 for admitting first contact means 52 to slots 44. |
| 48 | Bight | U-shaped section of clip 40 for engaging seat 30 to retain connector 38 upon ring 22. |
| 50 | Ports | Holes in upper section of bight 48 to permit frit access to the recess 30 in ledge 24 so that the peripheral edge of mask 20 is secured to the ledge in the recess area. |
| 52 | First Contact Means | Double-ended spring contact retained within slots 44 in shelf 42 of clip 40 to effect connection between screen 18 and clip 40. |
| 54 | Second Contact Means | Affixed to distal end of clip 40 to effect a conductive connection between Aquadag 14 and clip 40. |
| 56 | Stud | Capped conductive pin secured to clip 40 for mechanically and electrically connecting the collar 34 and cone 36 of IMS 32 to clip 40, see FIG. 4. |
| 58 | Retainer | Toothed washer for mechanically securing IMS 32 to Stud 56, see FIG. 4. |
| 60 | Frit | Bead of glass solder employed to bond faceplate 16 to face 26 of ring 22. |
| 62 | Frit | Bead of glass solder employed to bond seal land 13 of funnel 12 to face 28 of ring 22. |
| 64 | Frit | Bead of glass solder which bonds the peripheral edge of mask 20 to ledge 24 and also anchors clip 40 in ledge recess 30. |
| 66 | Conductive Frit | Bead of conductive glass for effecting an electrical connection between mask 20 and clip 40. Frit 66 may be confined to mask 20/clip 40 interface with conventional frit 64 used for mechanically bonding mask 20 to ledge 24. |
| 68 | Aquadag Stripe | Alternative means, in place of conductive frit 66, for effecting electrical connection between mask 20 and clip 40. |

OPERATION

Figure 7:
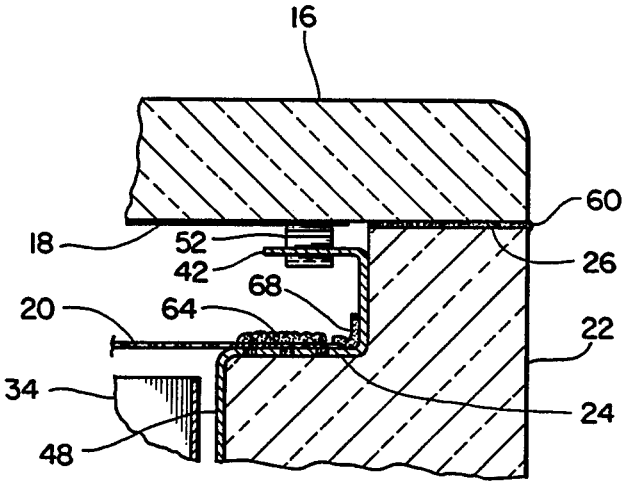
FIG. 7 is an enlarged view of a sectioned portion of FIG. 1 illustrating an alternate arrangement for effecting an electrical connection between the connector arrangement and the shadow mask.

Assembly and operation is as follows:

The bight portions 48 of clips 40 are inserted in their assigned recesses 30 and retained therein by the resiliency of clip 40. Short beads of conductive frit 66 are applied to those portions of clips 40 overlying recesses 30 to cover ports 50 to provide the necessary electrical connection between clip 40 and mask 20 as well as to bond the mask to ring ledge 24. Conventional frit 64 is applied to the remainder of ledge 42 not covered by conductive frit 66. Should the alternative approach for electrically connecting clip 40 to the mask be elected, a stripe 68 of Aquadag is applied, as by "painting", between the edge of foil mask 20 and clip 40, see FIG. 7.

The tensed foil mask 20 is then mounted upon the ring ledge 24 and the mask and ring assembly is then subjected to an elevated temperature to devitrify the frit and, thereby, bond the peripheral edge of foil 20 to ledge 24 as well as to anchor clips 40 in their assigned recess, the ports 50 in clip 40 permitting the conductive frit to weep through ports 50 to insure anchoring the foil edge to ledge 24 at the clip junctures.

The panel is then screened by using the mounted tensed foil as a stencil in the manner described in copending application Serial No. 538,001, filed Sep. 30, 1983, now Pat. No. 4,593,224.

After screening is completed, the double-ended contact 52 is then inserted through necks 46 to secure the contact in slots 44 of shelf 42.

Frit 60 is then applied to the sealing land of faceplate 16 (or to the sealing face 26 of ring 22) and the faceplate and ring 22 are then subjected to an elevated temperature to devitrify the frit and bond the faceplate and ring together. Note that as the faceplate and ring are joined, double-ended contact 52 is brought to bear against screen 18 to effect an electrical connection between screen 18 andd clip 40.

The collar 34 and cone 36 of IMS 32 are brought together and their respective mounting holes 35, 37 are aligned to permit mounting the collar and cone upon studs 56. Toothed retainers 58 are then slipped onto studs 56 to secure the collar and cone of IMS 32 thereon.

Frit 62 is applied to the seal land 13 of funnel 12 (or to rear face 28 of ring 22). The funnel and faceplate/ring assembly are then joined at their seal lands, which brings second contact means 54 into connective engagement with Aquadag coating 14 on the inside wall of funnel 12. The funnel and faceplate/ring assembly are then subjected to a devitrifying temperature to seal the funnel to the faceplate assembly to complete the envelope portion of CRT 10.

Alternatively, the bonding of faceplate 16 to the sealing face 26 of ring 22 can be achieved at the same time that face 28 of ring 22 is bonded to the seal land 13 of funnel 12, rather than as two separate operations as above described.

A ball and groove arrangement associated with ring 22 and faceplate 16, see the upper right corner of CRT 10 in FIG. 1, constitutes a means for indexing the faceplate upon ring 22 and forms no part of this invention.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in proper perspective based on the prior art.

We claim:

1. In a CRT comprising a funnel having a conductive coating applied to a selected area of its internal wall, a faceplate having a luminescent screen deposited upon its display surface, a ring formed of a non-conductive material and interposed between said funnel and said faceplate for supporting a tension color selection electrode in registration with said screen, an improved unitary connector arrangement for establishing said funnel coating, said screen, and said color selection electrode at a common electrical potential, said connector arrangement comprising:

a clip formed of a resilient conductive material and configured to be retained upon said ring;

first contact means supported by said clip for effecting a conductive engagement between said screen and said clip;

second contact means, also supported by said clip, for effecting a conductive engagement between said funnel coating and said clip; and means for effecting an electrical connection between said clip and said color selection electrode, whereby said screen, said funnel coating and said color selection electrode are established at a common electrical potential by said unitary connector arrangement.

2. A connector arrangement as set forth in claim 1 in which said means for effecting an electrical connection between said clip and said color selection electrode comprises conductive frit.

3. A connector arrangement as set forth in claim 1 in which said means for effecting an electrical connection between said clip and said color selection electrode comprises a strip of a conductive coating.

4. A connector arrangement as set forth in claim 1 in which each of said first and second contact means comprises a resilient spring contact.

5. In a CRT comprising a funnel having a conductive coating applied to a selected area of its internal wall, a faceplate having a luminescent screen deposited upon its display surface, a ring formed of a non-conductive material and interposed between said funnel and said faceplate for supporting a color selection electrode in registration with said screen and an internal magnetic shield disposed within said funnel, an improved unitary connector arrangement for establishing said funnel coating, said screen, said color selection electrode and said magnetic shield at a common electrical potential, said connector arrangement comprising:

a clip formed of a resilient conductive material and configured to be retained upon said ring;

first contact means supported by said clip for effecting a conductive engagement between said screen and said clip;

second contact means, also supported by said clip, for effecting a conductive engagement between said funnel coating and said clip;

means for effecting an electrical connection between said clip and said color selection electrode; and means for effecting a mechanical and electrical connection between said clip and said magnetic shield, whereby said screen, said funnel coating, said color selection electrode and said magnetic shield are established at a common electrical potential by said unitary connector arrangement.

6. A connector arrangement as set forth in claim 5 in which said means for effecting said mechanical and electrical connection between said clip and said shield comprises a conductive stud affixed to said clip.

* * * * *